US007223049B2

(12) United States Patent
Hall et al.

(10) Patent No.: US 7,223,049 B2
(45) Date of Patent: May 29, 2007

(54) APPARATUS, SYSTEM AND METHOD FOR DIRECTIONAL DEGRADATION OF A PAVED SURFACE

(76) Inventors: David R. Hall, 738 E. 2680 North, Provo, UT (US) 84606; Scott R. Little, 670 S. 1600 East, Pleasant Grove, UT (US) 84062; David Wahlquist, 498 W. 465 S., Spanish Fork, UT (US) 84660; Joe R. Fox, 572 S. 1750 East, Spanish Fork, UT (US) 84660

( * ) Notice: Subject to any disclaimer, the term of this patent is extended or adjusted under 35 U.S.C. 154(b) by 242 days.

(21) Appl. No.: 11/070,411

(22) Filed: Mar. 1, 2005

(65) Prior Publication Data

US 2006/0196698 A1 Sep. 7, 2006

(51) Int. Cl.
*E01C 23/12* (2006.01)

(52) U.S. Cl. ..... 404/93; 404/90; 404/94; 404/75

(58) Field of Classification Search ..... 404/90–94, 404/75

See application file for complete search history.

(56) References Cited

U.S. PATENT DOCUMENTS 3,848,687 A * 11/1974 Funakubo ..... 175/394
4,173,836 A * 11/1979 Paurat ..... 37/348
4,968,101 A * 11/1990 Bossow ..... 299/41.1
5,303,785 A * 4/1994 Duke ..... 175/57
5,332,051 A * 7/1994 Knowlton ..... 175/430
5,363,932 A * 11/1994 Azar ..... 175/417
5,765,926 A * 6/1998 Knapp ..... 299/39.3
6,953,303 B1 * 10/2005 Chase et al. ..... 404/94

* cited by examiner

*Primary Examiner*—Raymond Addie
(74) *Attorney, Agent, or Firm*—Daniel P. Nelson; Alexis V. Nelson; Tyson J. Wilde

(57) ABSTRACT

An apparatus, system and method for directionally degrading a paved surface. A substantially cylindrical rotary tool may include cutting inserts embedded within its cylindrical surface. The tool may be rotated about a rotational axis extending from a top end of the tool to its cutting head and may contact a paved surface such that the tool degrades the surface in a direction substantially normal thereto. The tool may be mounted to a motorized vehicle and adapted for independent movement to limit degradation to an isolated area, extend degradation beyond the width of the motorized vehicle, and/or avoid obstacles in the pavement.

18 Claims, 14 Drawing Sheets

APPARATUS, SYSTEM AND METHOD FOR DIRECTIONAL DEGRADATION OF A PAVED SURFACE

BACKGROUND OF THE INVENTION

1. Field of the Invention

The present invention relates to an apparatus, system and method for excavating a paved surface and, more particularly, to an apparatus, system and method for degrading a paved surface while avoiding surface obstacles.

2. Background

Modem road surfaces typically comprise asphalt, macadam, or other bituminous material processed and applied to form a smooth paved surface. Where low quality pavement components are used, or where pavement components are improperly implemented or combined, the paved surface may deteriorate quickly, necessitating frequent maintenance and repair. Even under normal conditions, temperature fluctuations, weather, and vehicular traffic over the paved surface may result in cracks and other surface irregularities over time. Road salts and other corrosive chemicals applied to the paved surface, as well as accumulation of water in surface cracks, may accelerate pavement deterioration.

Road resurfacing equipment may be used to degrade, remove, and/or recondition deteriorated pavement. Typically, heat generating equipment is used to soften the pavement, followed by equipment to degrade and plane the surface. New pavement materials may be worked into the degraded surface to recondition the pavement. The mixture may then be compacted to restore a smooth paved surface.

Conventional road cutting machines, however, are generally only capable of degrading an entire surface area corresponding to the width of the machine. Indeed, road cutting machines generally employ a cutting bit mounted to a cylindrical drum to contact and degrade pavement as the machine travels. As a result, a deteriorated pavement area must be large enough to accommodate the road cutting machine, and the area must be cleared of surface obstacles that may otherwise interfere with the cylindrical drum. Because the cylindrical drum extends the width of the machine and is dependent on the machine for its direction of travel, conventional road cutting machines are ill-equipped to maneuver around obstacles such as utility easements and boxes, manholes and manhole covers, culverts, rails, curbs, gutters, and other obstacles found in modern road ways.

Often, however, it is not desirable or cost effective to remove surface obstacles and resurface an entire road, especially in cases where only portions of the pavement have deteriorated. A paved surface may thus be allowed to continue to deteriorate until use of a conventional road cutting machine becomes appropriate. Until that time, the road may be patched to provide a temporary solution while delaying costs associated with road resurfacing.

Even where use of a conventional road cutting machine is deemed a cost effective and viable solution to pavement deterioration, peripheral pavement areas such as a shoulder of the road or the periphery of a manhole may be inaccessible to the machine. In such cases, manually operated impact devices such as jack hammers may be required, thereby further increasing the costs and resources associated with resurfacing a paved surface.

Accordingly, what are needed are a road degradation apparatus, system and method adapted to effectively degrade a paved surface while minimizing the costs traditionally associated with pavement resurfacing. Beneficially, such an apparatus would be capable of avoiding surface obstacles and degrading isolated or peripheral pavement areas, as well as being selectively implemented to degrade an entire road surface. Such an apparatus, system and method are disclosed and claimed herein.

SUMMARY OF THE INVENTION

The present invention has been developed in response to the present state of the art, and in particular, in response to the problems and needs in the art that have not yet been fully solved by currently available pavement degradation tools. Accordingly, the present invention has been developed to provide an apparatus, system and method for degrading a paved surface that overcome many or all of the above-discussed shortcomings in the art.

An apparatus in accordance with certain embodiments of the present invention may include a substantially cylindrical rotary element having a cutting head, a top end and a substantially cylindrical surface. The substantially cylindrical surface may be formed about a rotational axis longitudinally extending from the cutting head to the top end, where the rotary element rotates about the rotational axis. In some embodiments, a central bore may extend from the top end to the cutting head along the rotational axis and be adapted to direct rejuvenation materials to the paved surface.

The apparatus may further include cutting inserts embedded within the substantially cylindrical surface such that the apparatus may degrade a paved surface in a direction substantially normal to the rotational axis. In certain embodiments, the cutting inserts may include a substrate bonded to a cutting material such as polycrystalline diamond or cubic boron nitride. Further, in some embodiments, at least one plunging element may be coupled to the cutting head to impact the paved surface. In certain embodiments, the top end of the rotary element may include an annular recess to direct degraded pavement particles away from the cutting inserts.

A system of the present invention is also presented to directionally degrade a paved surface. The system may be embodied by a motorized vehicle having at least one degradation tool coupled thereto. As in the apparatus, the degradation tool may include a top end, a cutting head and a cylindrical surface, where cutting inserts are embedded within the cylindrical surface to degrade a paved surface in a direction substantially normal to the tool's axis of rotation. A motorized vehicle may include, for example, a tractor, a loader, a backhoe, a road grader, a bulldozer or an excavator.

In some embodiments, a system may further include an attachment assembly attached to each of the motorized vehicle and the degradation tool. An attachment assembly may include a mounting member capable of extending beyond a width of the motorized vehicle. In some embodiments, the mounting member may have an array of degradation tools mounted thereto, where each degradation tool is capable of independent and/or collective movement, or a combination thereof.

A system in accordance with the present invention may further comprise an actuating mechanism to actuate a tool in a direction independent of the motorized vehicle. For example, the actuating mechanism may move the tool in a horizontal, vertical, transverse, diagonal or pivotal direction relative to the motorized vehicle, or a combination thereof. In certain embodiments, a control device may be operatively coupled to the actuating mechanism to control the direction of the tool. A control device may include, for example, an automated feedback system or a manually operated system.

A method of the present invention is also presented for degrading a paved surface. In one embodiment, the method includes providing at least one degradation tool having a top end, a cutting head, and a substantially cylindrical surface. The method may further include coupling to the substantially cylindrical surface multiple cutting inserts, rotating the tool about a rotational axis substantially normal to the paved surface, and contacting the paved surface with the tool to degrade the same.

In certain embodiments, a method may further include providing a motorized vehicle to traverse the paved surface, coupling to the motorized vehicle the degradation tool, and actuating the tool in a direction independent of the motorized vehicle. For example, the degradation tool may be actuated in a direction horizontal, vertical, transverse, diagonal or pivotal relative to the motorized vehicle. In this manner, the present invention enables controlled degradation of a paved surface that may be limited to an isolated area, extended to degrade an area wider than the width of a motorized vehicle, or coordinated to avoid obstacles in the pavement.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter. dr

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

In this application, "pavement" or a "paved surface" refers to any compact, wear resistant surface that facilitates vehicular, pedestrian, or other form of traffic. Pavement may comprise oil, tar, tarmac, macadam, tarmacadam, asphalt, asphaltum, pitch, bitumen, minerals, rocks, pebbles, gravel, sand, polyester fibers, Portland cement and/or petrochemical binders. The term "horizontal" refers to a direction corresponding to a width of a motorized vehicle. The term "transverse" refers to a direction corresponding to a length of a motorized vehicle, measured from the front of the vehicle to the rear of the vehicle. Finally, reference in this application to one of "polycrystalline diamond" and "cubic boron nitride" is reference to the other.

Figure 1:
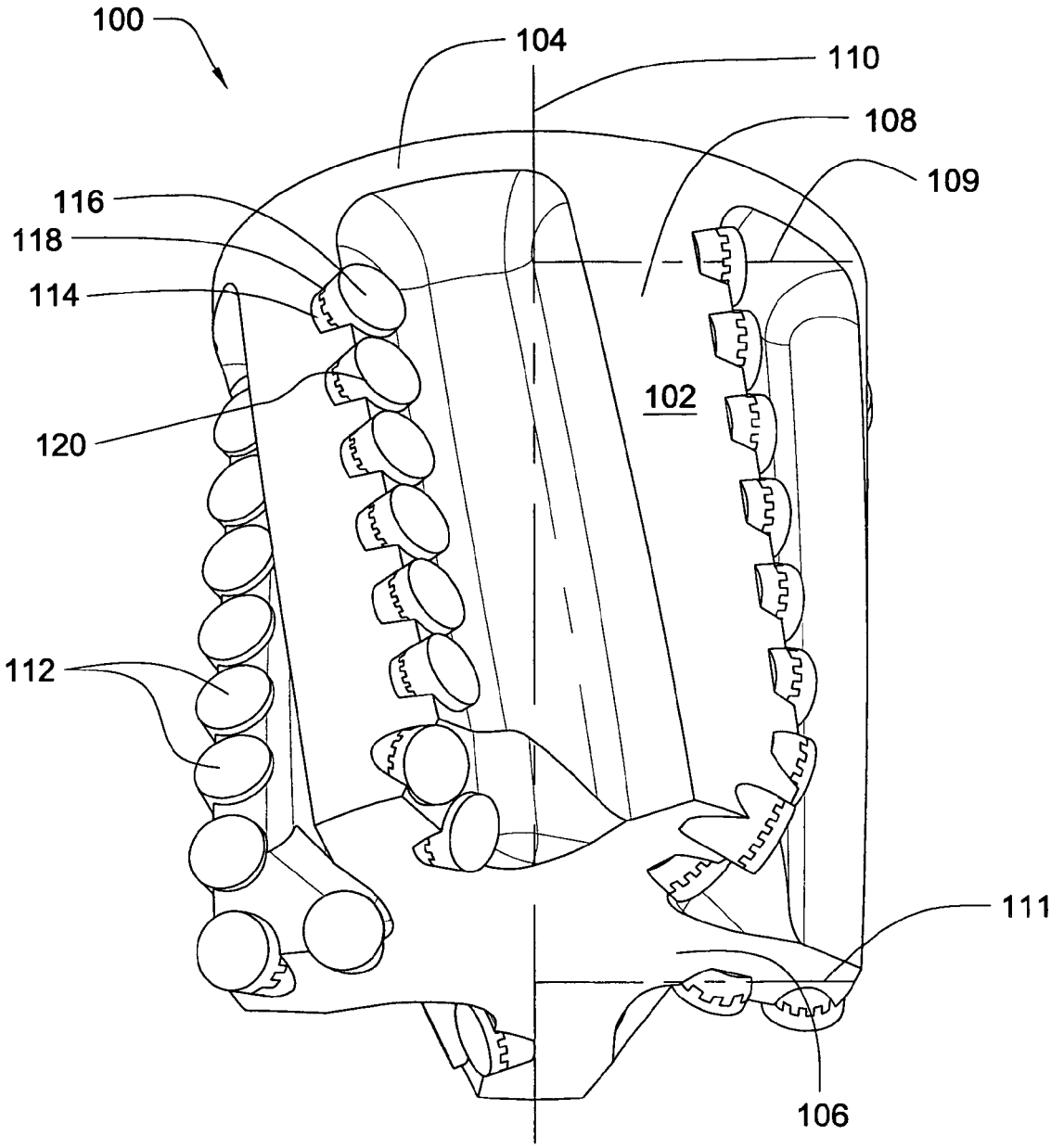
FIG. 1 is a perspective view of one embodiment of a degradation apparatus in accordance with the present invention.

Referring now to FIG. 1, a degradation apparatus or tool 100 in accordance with the present invention may include a rotary element 102 having a top end 104, a cutting head 106 and a substantially cylindrical surface 108. The rotary element 102 may be formed from an abrasion resistant material such as high-strength steel, hardened alloys, cemented metal carbide, or any other such material known to those in the art. In certain embodiments, the rotary element 102 may further include a surface coating such as ceramic, steel, ceramic steel composite, steel alloy, bronze alloy, tungsten carbide, or any other heat tolerant, wear resistant surface coating known to those in the art.

A top end 104 of the rotary element 102 may be substantially flat and may be adapted to be rotatably retained by a stationary frame, or by an attachment assembly coupled to a motorized vehicle on wheels or tracks, as discussed in more detail with reference to FIG. 3. Alternatively, a top end 104 may assume any shape known to those in the art. A top end 104 may include a radius 109 substantially corresponding to a radius 111 of the cutting head 106, and may reside substantially parallel thereto, such that the rotary element 102 may approximate a round cylinder.

Indeed, a substantially cylindrical surface 108 may extend between the top end 104 and the cutting head 106 such that each of the top end 104 and cutting head 106 may approximate bases of the rotary element 102, with the length of the substantially cylindrical surface 108 substantially corresponding to rotary element 102 height. A rotational axis 110 may be disposed between the top end 104 and the cutting head 106 such that the rotational axis 110 also substantially corresponds to the rotary element 102 height. During operation, the rotational axis 110 may be disposed substantially normal to a paved surface and the rotary element 102 may rotate in a forward or reverse direction about the rotational axis 110 to degrade a paved surface in a direction substantially normal to such surface. Cutting inserts 112 may be coupled to the substantially cylindrical surface 108 to facilitate degradation of a paved surface, as discussed in more detail below.

A cutting head 106 of the rotary element 102 may be substantially convex, cone-shaped, pyramidal, flat, or any other shape capable of impacting a paved surface in accordance with the present invention. In some embodiments, a cutting head 106 includes various contours capable of providing mechanical support and effectively distributing mechanical stresses imposed on the rotary element 102 upon impacting a paved surface.

As mentioned above, cutting inserts 112 may be coupled to the cylindrical surface 108 to facilitate effective pavement degradation. A cutting insert 112 may generally comprise a substrate 114 bonded to a cutting material 116. In some embodiments, the substrate 114 and cutting material 116 may be arranged in two or more layers. A substrate 114 may comprise, for example, tungsten carbide, high-strength steel, or other material known to those in the art.

In certain embodiments, a substrate 114 and/or cutting material 116 may further comprise a binder-catalyzing material such as cobalt, nickel, iron, a carbonate, or any other metal or non-metal catalyst known to those in the art to facilitate binding the substrate 114 to the cutting material 116. Alternatively, a binder-catalyzing material may be implemented between the substrate 114 and cutting material 116. Certain binding processes in accordance with the present invention, for example, include subjecting a cobalt-containing substrate 114 and a cutting material 116 to high temperature and pressure to cause cobalt to migrate from the substrate 114 to the cutting material 116, thus binding the cutting material 116 to the substrate 114. Where cobalt or other binder-catalyzing material is implemented to facilitate a binding process, however, the binder-catalyzing material may be later leached out of at least a portion of the cutting material 116 to promote the cutting material's 116 ability to resist thermal degradation. For example, working surfaces 120 of a cutting material 116 bonded to a substrate 114 may be depleted of catalyzing material to improve wear resistance without loss of impact strength, as described in U.S. Pat. No. 6,544,308 to Griffin, incorporated herein by reference.

A cutting material 116 in accordance with the present invention may comprise natural diamond, synthetic diamond, polycrystalline diamond, cubic boron nitride, a composite material, or any other suitable material known to those in the art. Cutting material 116 crystals may vary in size to promote wear resistance, impact resistance, or both. In certain embodiments, a cutting material 116 may comprise a material modified to exhibit certain qualities favorable for its use in pavement degradation. For example, in some embodiments a cutting material 116 may comprise thermally stable polycrystalline diamond or partially thermally stable polycrystalline diamond.

In certain embodiments, a substrate 114 may comprise dimensions substantially corresponding to dimensions of the cutting material 116 to facilitate overall cutting insert 112 uniformity. In certain embodiments, a cutting insert 112 may comprise a substantially circular cross-sectional profile having a blunt working surface 120. The substrate 114 may be embedded in the substantially cylindrical surface or may project from the substantially cylindrical surface 108. A cutting insert 112 in accordance with the present invention may comprise an elliptical, conical, rectangular, square, or any other shape or cross-sectional profile.

A cutting material 116 and substrate 114 may form a non-planar physical interface 118 to improve surface attachment therebetween. A non-planar interface 118 may comprise, for example, a convex interface, a concave interface, grooves, nodes, ridges, dimples, a top hat configuration, or any other variety of non-planar physical interfaces. Accordingly, a depth of the cutting material 116 may vary with respect to a depth of a substrate 114. Alternatively, a cutting material 116 may form a planar interface 118 with a substrate 114. Examples of non-planar interfaces are illustrated at FIGS. 12 through 35.

Working surfaces 120 of the cutting material 116 may include a chamfered or beveled edge to facilitate wear and durability while maintaining efficient cutting capabilities. In certain embodiments, a working surface 120 may include a double or multiple chamfered edge to further increase mechanical support and alleviate mechanical stresses on the cutting insert 112. In one embodiment, a cutting material 116 interfaces with a substrate 114 in a top hat or other configuration such that a depth of cutting material 116 is greatest along working surfaces 120 to support cutting insert 112 durability and stress resistance. Additionally, a working surface 120 in accordance with the present invention may be rounded, and in certain embodiments, polished to promote both cutting efficiency and wear resistance. In certain embodiments, the working surface 120 may be textured or otherwise contoured.

Figure 2:
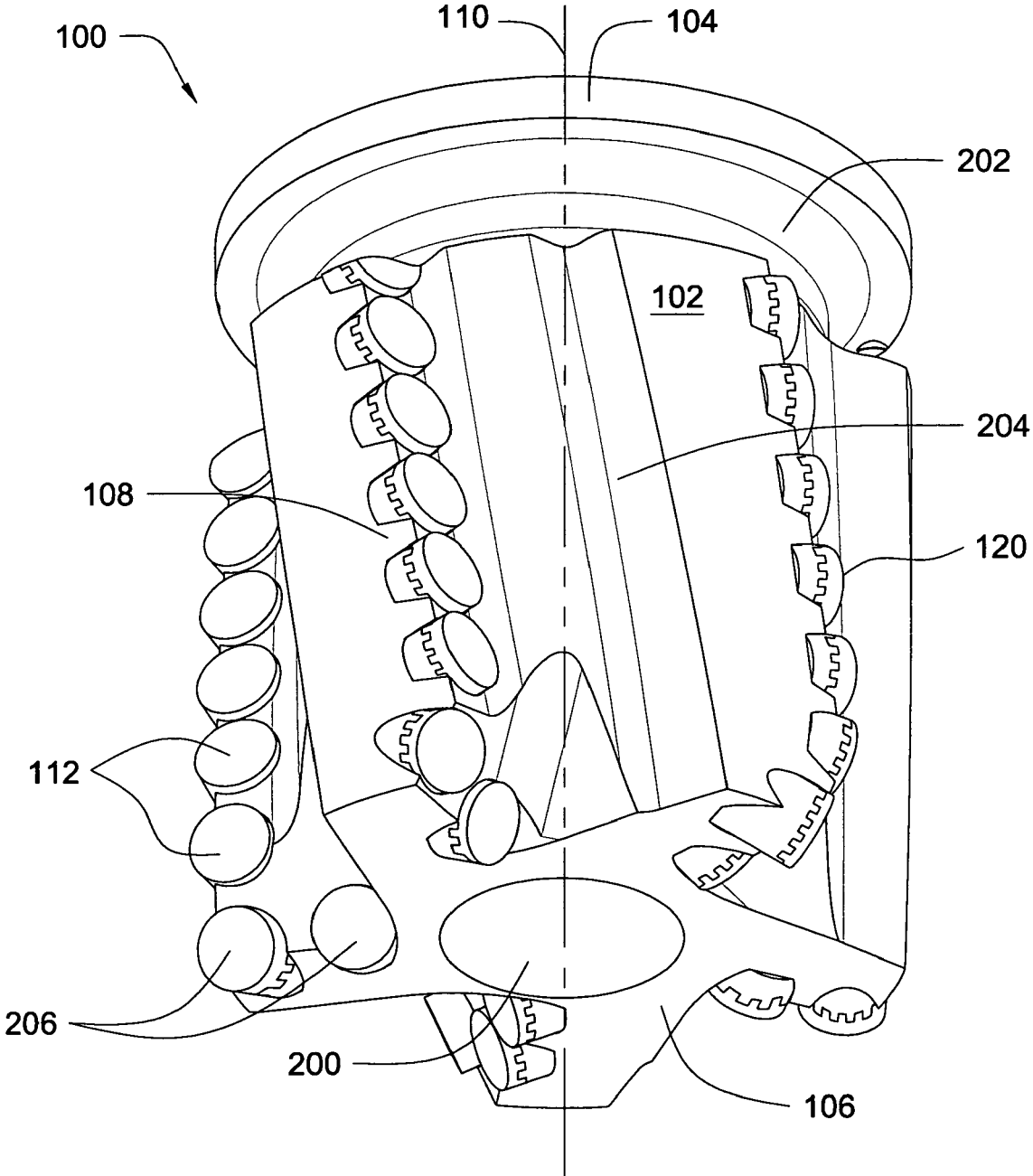
FIG. 2 is a perspective view of an alternative embodiment of a degradation apparatus.

Referring now to FIG. 2, in some embodiments, a central bore 200 may extend the length of the rotary element 102 from the top end 104 to the cutting head 106, substantially corresponding to the rotational axis 110. The central bore 200 may communicate with a remote supply of pavement renewal materials such as asphalt, petrochemical binders, oil, tar, asphaltum, macadam, tarmacadam, tarmac, pitch, bitumen, minerals, rocks, pebbles, gravel, sand, and/or any other pavement renewal material known to those in the art. The central bore 200 may accommodate a flow of such pavement renewal materials through the rotary element 102 during degradation. In this manner, renewal materials may be added in situ to facilitate concurrent or later pavement resurfacing.

In certain embodiments of the present invention, a pavement degrading apparatus 100 includes one or more plunging elements 206 coupled to the substantially cylindrical surface 108 proximate the cutting head 106. A plunging element 206 may be similar or identical to a cutting insert 112, though distinguishable by location. Indeed, a plunging element 206 may be situated at a substantially oblique angle relative to the cutting head 106 to initially penetrate a paved surface. In some embodiments, more than one plunging element 206 may be integrated into the rotary element 102 to further support a thrust force into the paved surface. Where a rotary element 102 integrates one or more substantially vertical recesses 204, multiple plunging elements 206 may be coupled to a distal end of each substantially vertical recess 204.

An annular recess 202 may be circumscribed about the rotary element 102 proximate the top end 104 to direct degraded pavement particles away from the cutting inserts 112. Where substantially vertical recesses 204 are formed in the substantially cylindrical surface 108, lateral edges of the annular recess 202 may communicate with proximate ends of the substantially vertical recesses 204 to facilitate movement of degraded pavement particles towards the annular recess 202, thus preventing particle buildup within the vertical recesses 204 that may interfere with effective pavement degradation. Substantially vertical recesses 204 may be oriented to resemble a forward helix, a reverse helix, a vertical line, or any other shape known to those in the art.

Figure 3:
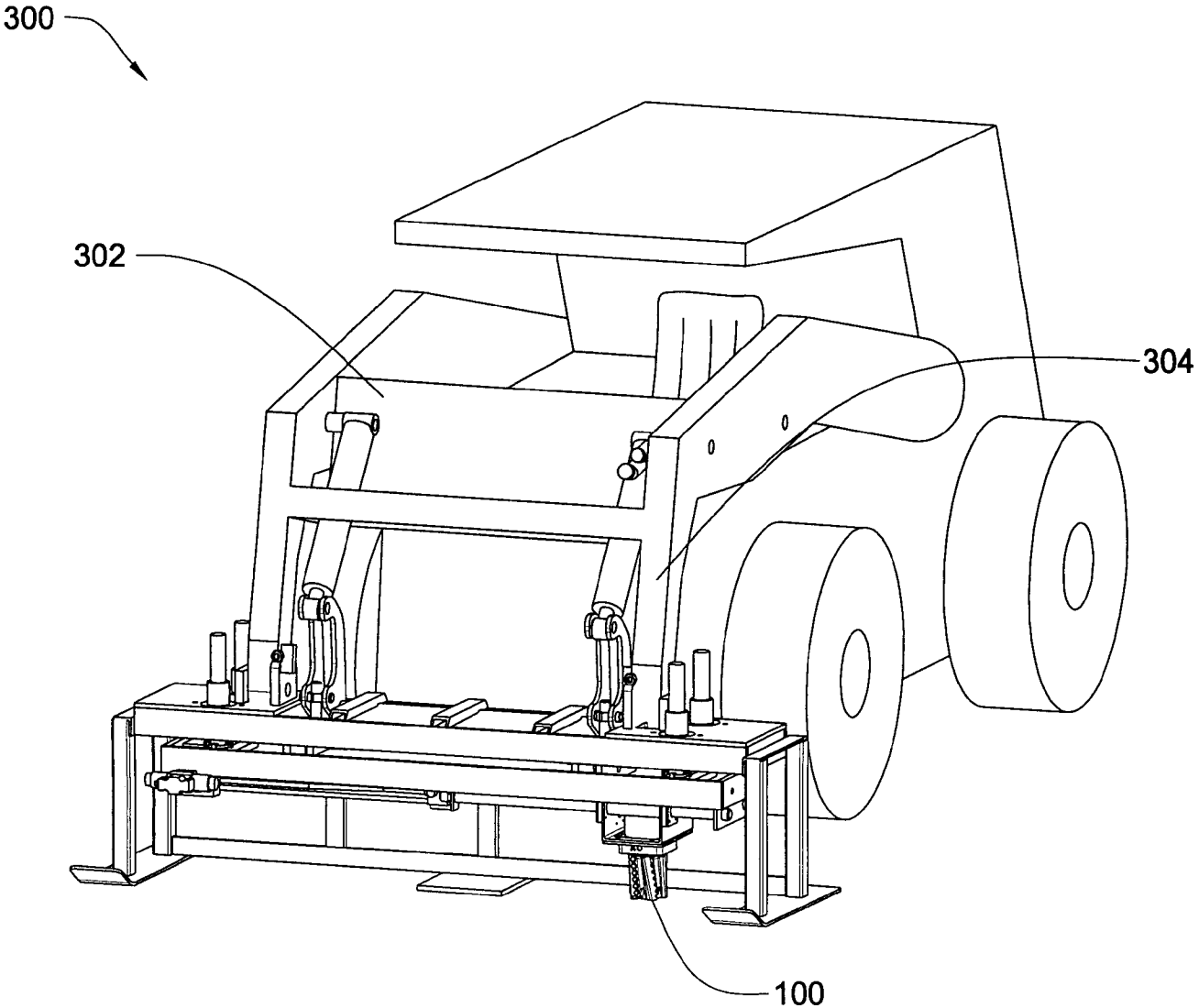
FIG. 3 is a perspective view of a degradation apparatus attached to a motorized vehicle in accordance with certain embodiments of the present invention.

Referring now to FIG. 3, a pavement degradation system 300 in accordance with the present invention may include a degradation apparatus 100 attached to a motorized vehicle 302. Alternatively, a pavement degradation system 300 may include a degradation apparatus 100 mounted to a stationary frame.

A motorized vehicle 302 may comprise, for example, a tractor, a loader, a backhoe, a bulldozer, a road grader, asphalt cold planar, or any other motorized vehicle 302 known to those in the art. In some embodiments, an attachment assembly 304 may facilitate attachment of the apparatus 100 to the motorized vehicle 302. A degradation apparatus 100 may attach to an end of the motorized vehicle 302, to an intermediate location on the motorized vehicle 302 chassis, or at any other location on a motorized vehicle 302 known to those in the art. The degradation apparatus 100 may be rotatably retained by the motorized vehicle 302 or attachment assembly 304 to enable rotation of the rotary element 102 about the rotational axis 110 in accordance with the present invention.

A pavement degradation system 300 may include an actuating mechanism (not shown) to enable independent displacement of the degradation apparatus 100 relative to the motorized vehicle 302 or stationary frame to which it is attached. As discussed in more detail with reference to FIGS. 4–10 below, an actuating mechanism may enable the apparatus 100 to move vertically, horizontally, transversely, diagonally and/or pivotally without regard to the vehicle 302 or frame. In some embodiments, an actuating mechanism may enable independent movement of an apparatus 100 with respect to a motorized vehicle 302 or stationary frame in response to unanticipated or unavoidable variances in surface or sub-surface pavement conditions. In other embodiments, an actuating mechanism may be selectively deliberately actuated to vary a vertical, horizontal, pivotal, or other position of a degradation apparatus 100 according to perceived surface defects, obstacles, or to conform to a particular surface geometry. An actuating mechanism in accordance with the present invention may comprise a mechanical device, a hydraulic device, a pneumatic device, an electrical device, a combination thereof, or any other device known to those in the art capable of allowing independent movement of the apparatus 100 relative to a motorized vehicle 302 or stationary frame.

One or more control devices (not shown) may communicate with an actuating mechanism to facilitate automated or manually controlled directional movement of an apparatus 100 relative to a motorized vehicle 302 or stationary frame. Specifically, a control device in accordance with the present invention may comprise a manually operated mechanical, electrical, hydraulic, pneumatic, magnetic or other device known to those in the art. Alternatively, a control device may comprise an automated or closed loop system including computers, programmable logic controllers, electromechanical systems, sensors and linear measurement devices, nuclear resonance imaging devices, magnetic resonance imaging devices, and/or any other such device or system known in the art. In some embodiments, a closed loop system may cooperate with operator manual controls, preset controls, operator input, and degradation apparatus 100 to identify and respond to various conditions in the pavement, such as cracks, potholes, manhole covers, rails, and other surface conditions and obstacles. In addition to controlling the directional movement of the degradation apparatus 100, a closed loop system may respond to identified conditions by controlling the degradation apparatus' 100 load, its speed, the addition of renewal materials to the paved surface, and other operational parameters.

Figure 4:
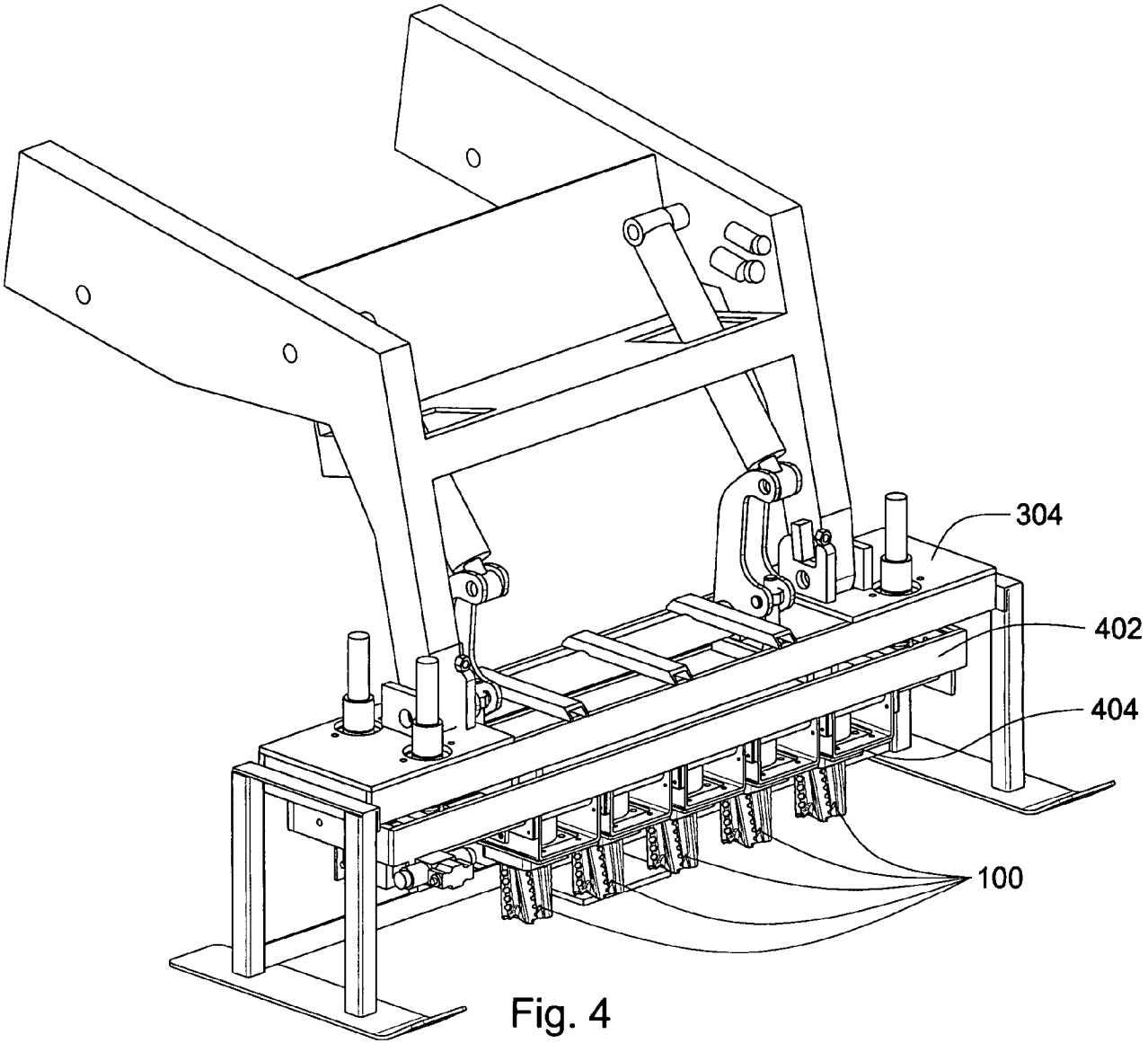
FIG. 4 is a perspective view of an embodiment of an array of degradation tools in accordance with the present invention.

Referring now to FIG. 4, in certain embodiments, a pavement degradation system 300 may include one or more mounting members 402 integral to an attachment assembly 304, where each mounting member is capable of rotatably retaining a plurality of degradation apparatuses 100. A mounting member 402 may be adapted for independent movement relative to a motorized vehicle 302 or stationary frame to which it is mounted. In this manner, the mounting member 402 may enable more than one degradation apparatus 100 to move as a unitary set in a direction independent of the motorized vehicle 302 or stationary frame. A mounting member 402, for example, may be displaced from a motorized vehicle 302 or stationary frame in any of a vertical, horizontal, diagonal, transverse or pivotal direction, or a combination thereof.

A mounting member 402 may be operatively connected to an actuating mechanism as discussed above with reference to FIG. 3. In certain embodiments, the actuating mechanism selected to induce independent movement of the mounting member 402 may also function to induce rotational movement and/or independent directional movement of at least one individual degradation apparatus 100 attached to the mounting member 402.

In one embodiment, a mounting member 402 comprises a longitudinal arm capable of linearly retaining a plurality of degradation apparatuses 100. The arm may include a plurality of retaining apertures 404, where each retaining aperture 404 corresponds to a degradation apparatus 100. A retaining aperture 404 may be adapted to permit rotational movement of the degradation apparatus 100 retained thereby. Further, in certain embodiments, the retaining aperture 404 may enable independent vertical, horizontal, diagonal, transverse, or pivotal movement of its corresponding degradation apparatus 100. In certain embodiments, a retaining aperture 404 may include one or more bearing elements (not shown) to reduce friction between the degradation apparatus 100 and retaining aperture 404. Bearing elements may include one or more bushings and bearings such as bushings, roller bearings, ball bearings, needle bearings, sleeve bearings, thrust bearings, linear bearings, tapered bearings, or any other bushing or bearing device known to those in the art.

Figure 5:
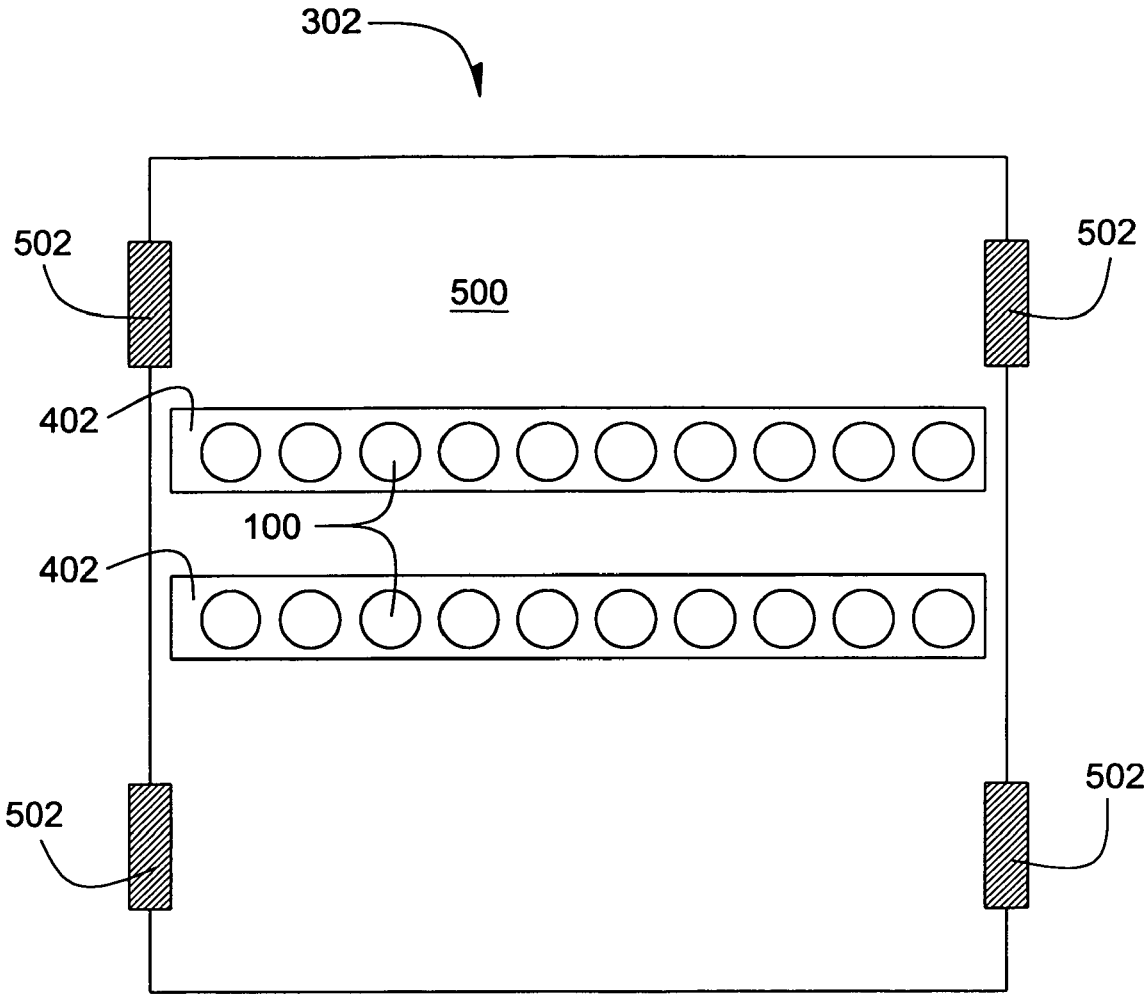
FIG. 5 is a bottom view of one embodiment of a motorized vehicle having arrays of degradation tools mounted in accordance with certain embodiments of the present invention.

Referring now to FIG. 5, more than one mounting member 402 may be mounted to a motorized vehicle 302, each acting either independently or cooperatively with each other. In certain embodiments, for example, a pair of mounting members 402 may be attached in parallel beneath a motorized vehicle 302 to the vehicle chassis 500. The mounting members 402 may substantially correspond to a mid-section of the vehicle 302 to prevent vehicular imbalance as well as to avoid interference with one or more vehicular tires or tracks 502. The mounting members 402 and/or individual degradation apparatuses 100 retained thereby may be selectively vertically elevated to clear a paved surface during vehicular travel.

In certain embodiments, each mounting member 402 may be adapted for independent horizontal movement relative to the motorized vehicle 302 such that the pair of mounting members 402 may cooperate to selectively degrade an area having a width greater than the motorized vehicle 302.

Figure 6:
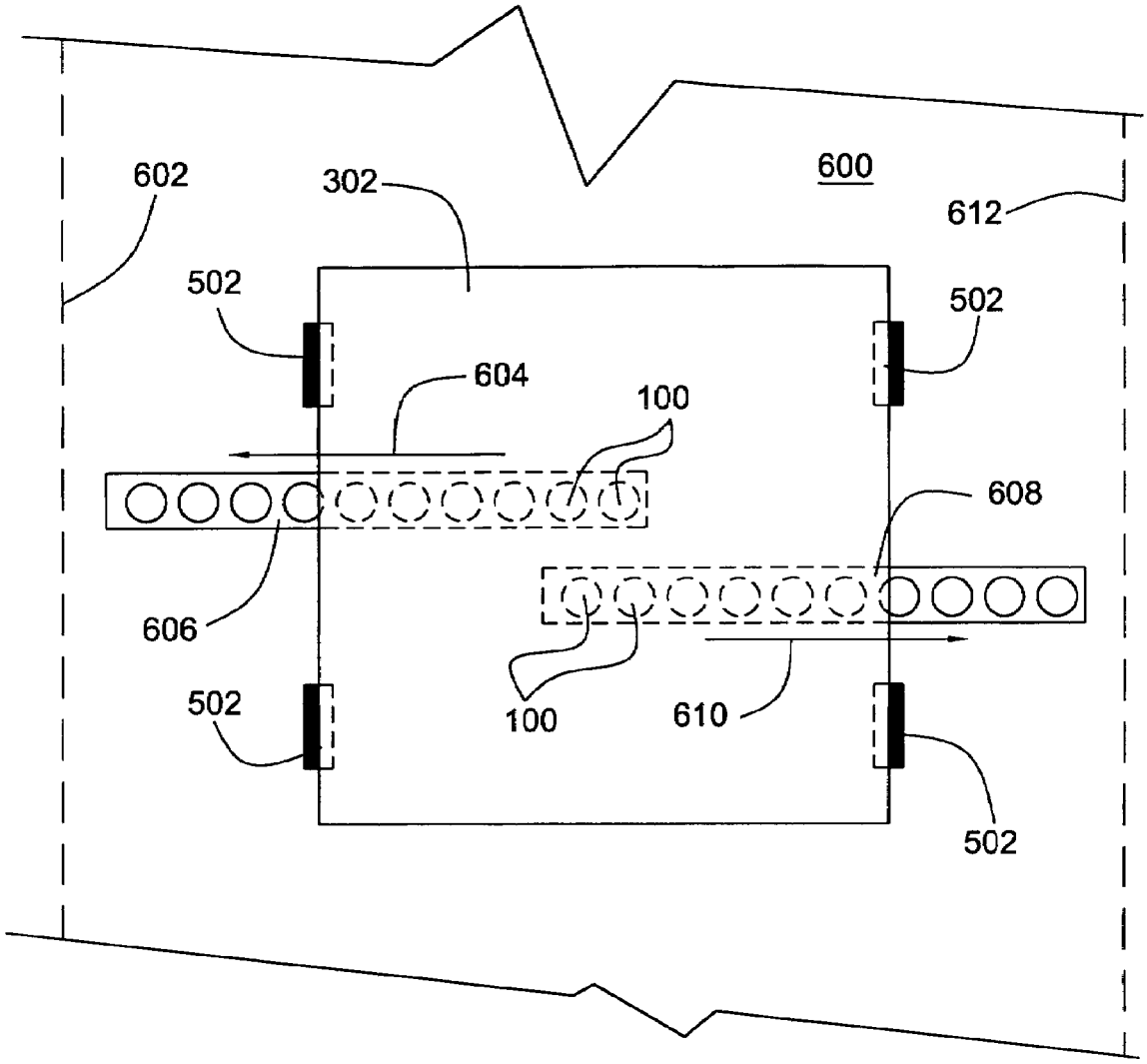
FIG. 6 is a top view of the embodiment of the present invention depicted in FIG. 5 that illustrates lateral expansion capabilities of the degradation tool arrays in accordance with certain embodiments of the present invention.

Referring now to FIG. 6, a road lane 600 is typically wider than the width of a motorized vehicle 302. Indeed, in the United States, a road lane 600 is commonly between about ten and twelve feet wide. An industrial motorized vehicle, on the other hand, usually comprises a width of about eight feet. Accordingly, certain embodiments of the present invention provide a pair of longitudinal mounting members 402 mounted in parallel beneath a vehicle 302. A first mounting member 606 may be adapted for horizontal movement in a first direction 604, while a second mounting member 608 may be adapted for horizontal movement in an opposite direction 610. In operation, first and second mounting members 606 and 608 may be actuated sequentially or substantially simultaneously in opposite horizontal directions 604 and 610 to effectively expand an array of degradation apparatuses 100 to occupy a width greater than the width of the motorized vehicle 302. In certain embodiments, for example, a pair of mounting members 402 may each comprise a length of eight feet and be mounted to a vehicle chassis 500 in parallel such that displacement of each in opposite horizontal directions produces an array of degradation apparatuses 100 having a sixteen-foot swath. In this manner, first and second mounting members 606 and 608 may be extended such that degradation apparatuses 100 mounted thereto may substantially simultaneously degrade an entire road lane 600 width, measured from shoulder 612 to road median 602, in a single pass.

Figure 7:
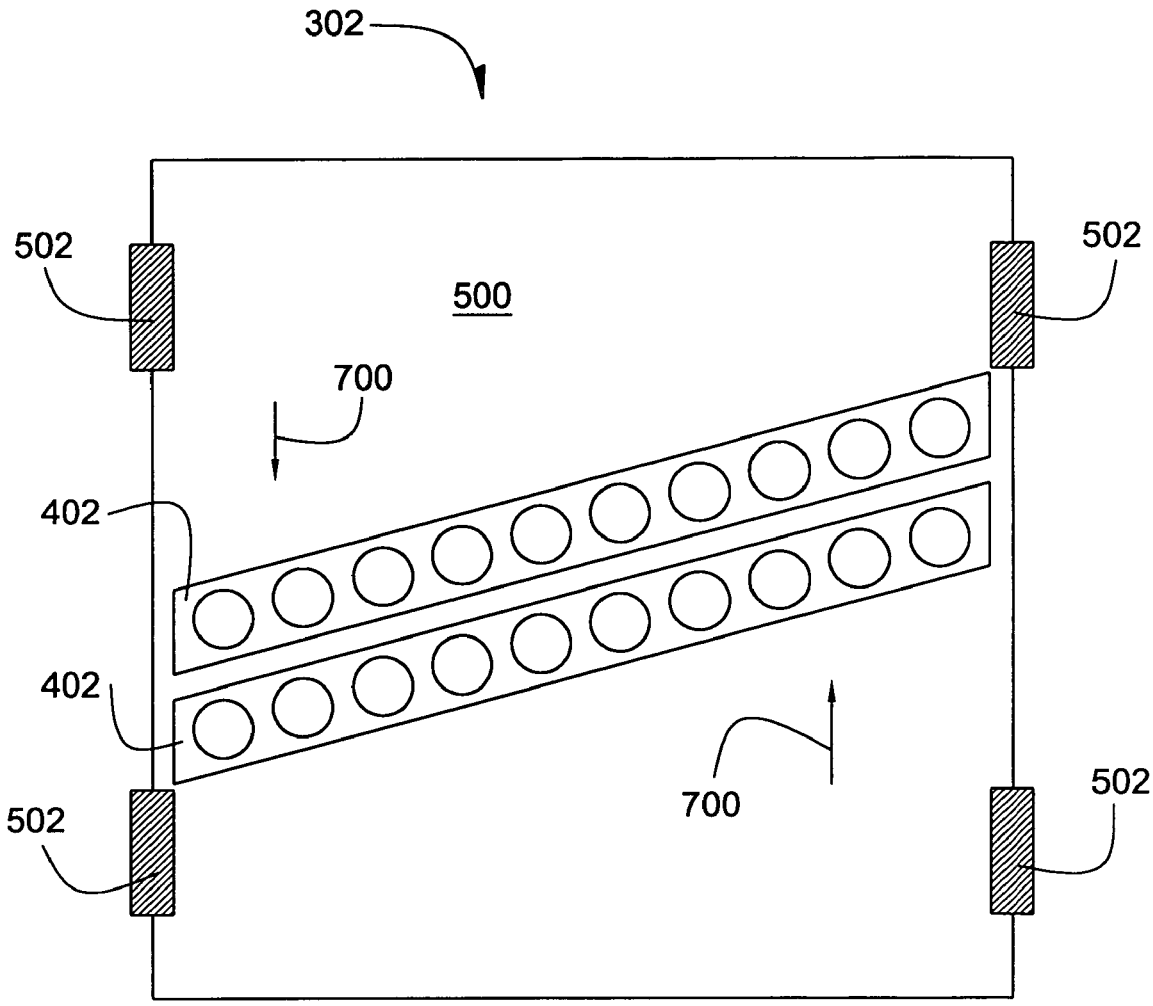
FIG. 7 is a bottom view of the embodiment of the present invention depicted in FIG. 5 that illustrates diagonal directional capabilities of the degradation tool arrays in accordance with certain embodiments of the present invention.

Referring now to FIG. 7, one or more mounting members 402 may be attached to a motorized vehicle 302 at a diagonal and/or adapted for diagonal movement relative to the motorized vehicle 302. For example, a pair of mounting members 402 may be attached to a vehicle chassis 500 in parallel and adapted for diagonal movement relative to the chassis 500. In one embodiment, the mounting members 402 are attached to the chassis 500 by attachment means (not shown) at a location substantially corresponding to a midpoint of the vehicle 302. In certain embodiments, the attachment means may selectively rotate the mounting members 402 at a location intermediate the ends of the mounting members 402 such that each end of a mounting member 402 is urged in an opposite transverse direction 700. In this manner, mounting members 402 may selectively assume a diagonal position relative to the motorized vehicle 302 to which they are attached. Of course, one skilled in the art will recognize that various methods exist for selectively diagonally displacing one or more mounting members 402 relative to a motorized vehicle 302 or stationary frame to which it is attached, and that any such method is contemplated as within the scope of the present invention.

Figure 8:
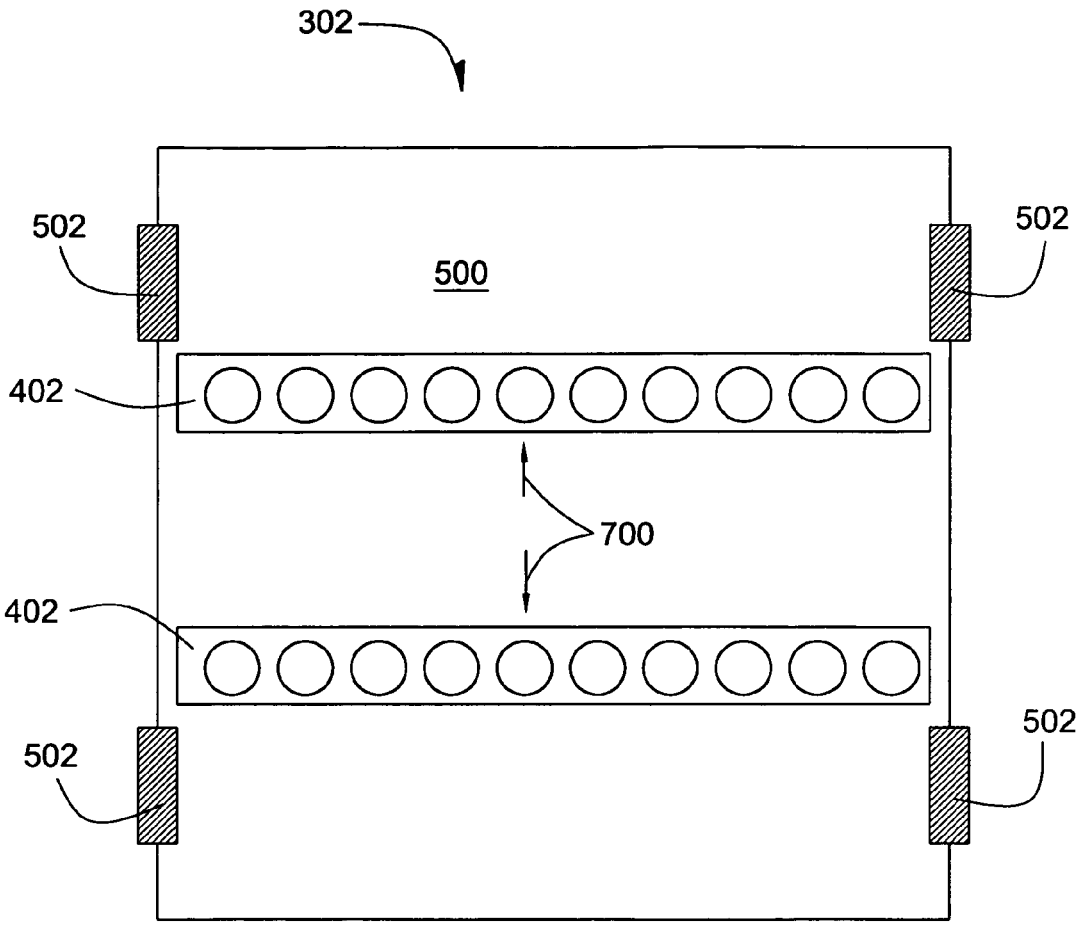
FIG. 8 is a bottom view of the embodiment of the present invention depicted in FIG. 5 that illustrates transverse expansion capabilities of the degradation tool arrays in accordance with certain embodiments of the present invention.

Referring now to FIG. 8, certain embodiments of the present invention contemplate displacing a mounting member 402 in a transverse direction 700 relative to a motorized vehicle 302 or stationary frame to which it is mounted. Specifically, a mounting member 402 may be adapted to move transversely from a first position to a second position substantially parallel to the first position. In some embodiments, a plurality of mounting members 402 may be attached a vehicular chassis 500 or stationary frame and adapted for independent or cooperative movement in a transverse direction 700. For example, a pair of mounting members 402 may be attached to a vehicle chassis 500 in parallel and may be selectively transversely displaced in opposite directions to increase a distance between the members 402. Alternatively, the mounting members 402 may be selectively transversely displaced in the same direction.

Figure 9:
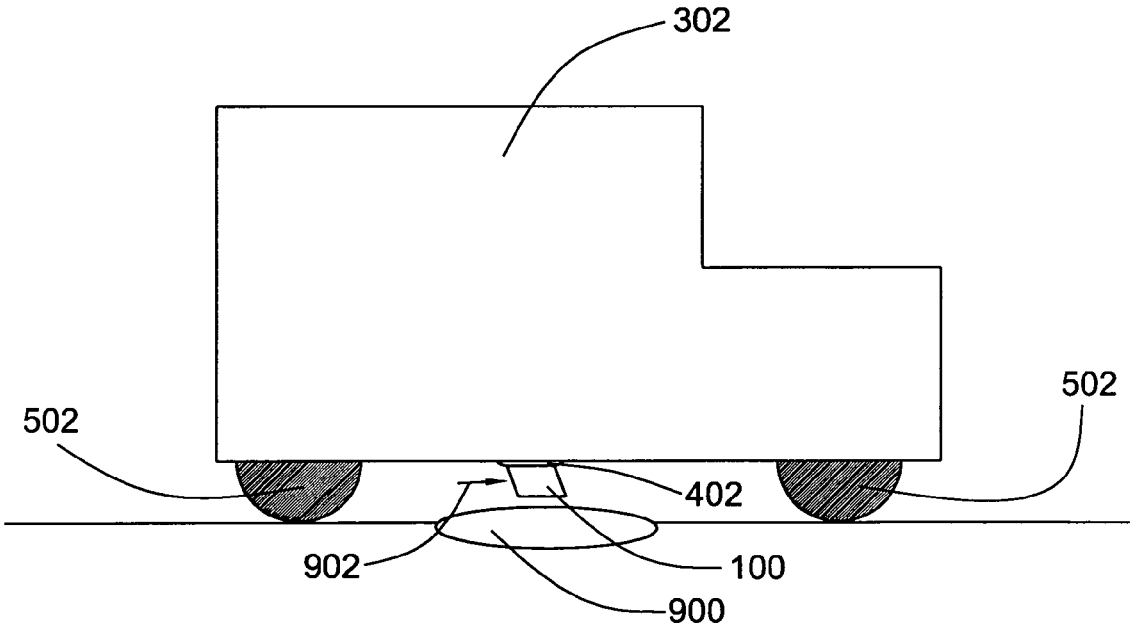
FIG. 9 is a side view of one embodiment of the present invention depicting pivotal movement capabilities of a degradation tool.

Referring now to FIG. 9, a mounting member 402 and/or individual degradation apparatuses 100 may be adapted for pivotal movement relative to a motorized vehicle 302 or stationary frame to which it is attached. In certain embodiments, a mounting member 402 may be selectively actuated to pivot in a direction to cause all degradation apparatuses 100 attached thereto to move accordingly. In this manner, such degradation apparatuses 100 may cooperate to avoid a surface obstacle, or to adapt to variances in surface geometry.

In other embodiments, individual degradation apparatuses 100 may be adapted for movement in a pivotal direction 902 relative to a motorized vehicle 302, mounting member 402, or stationary frame to which they are attached. Pivotal movement is not limited to a forward pivot, and may include any circular pivotal direction. In this manner, selected degradation apparatuses 100 may pivot to avoid or adapt to a particular surface condition, such as a pothole 900, while other degradation apparatuses 100, even those mounted on the same mounting member 402, may maintain a fixed position. One skilled in the art will recognize, however, that pivotal movement capabilities of a mounting member 402 and individual degradation apparatuses 100, as well as other directional movement capabilities as discussed herein, may be synergistic to enable a wider range of movement and more precise implementation of any particular degradation apparatus 100 or array of degradation apparatuses 100 as appropriate.

Figure 10:
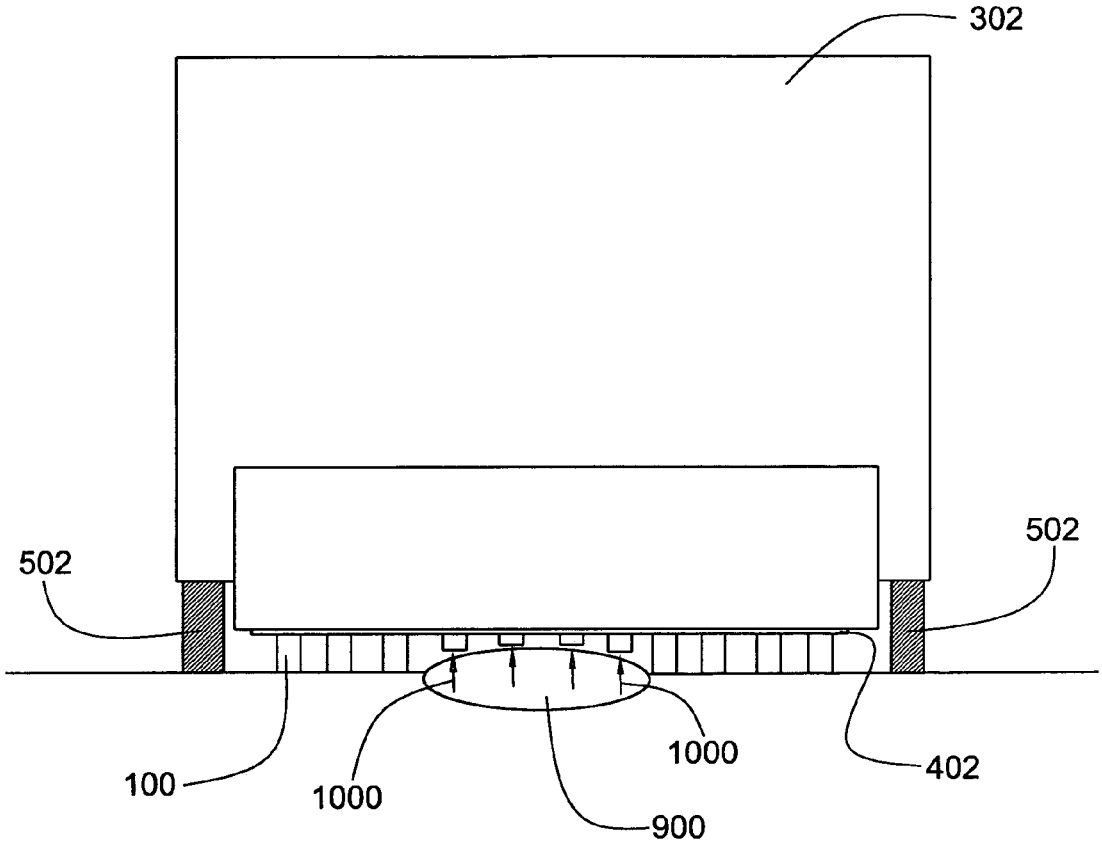
FIG. 10 is a front view of a motorized vehicle and attached array of degradation tools implemented to avoid an obstacle in the paved surface in accordance with certain embodiments of the present invention.

Referring now to FIG. 10, a mounting member 402 and/or individual degradation apparatus 100 may be further adapted for vertical movement, as mentioned previously with reference to FIG. 5. In addition to enabling clearance of a paved surface during vehicular travel, however, a mounting member 402 and/or individual degradation apparatus 100 may be selectively actuated in a vertical direction 1000 to avoid a surface obstacle 900, to conform to a surface geometry, or for any other reason known to those in the art. As discussed previously with reference to FIG. 9, a single degradation apparatus 100 may be selectively vertically displaced, two or more degradation apparatuses 100 may be selectively vertically displaced in tandem, a mounting member 402 may be vertically displaced to indirectly impose vertical displacement on individual degradation apparatuses 100 attached thereto, and/or a mounting member 402 may be synergistically vertically displaced with one or more individual degradation apparatuses 100.

Figure 11:
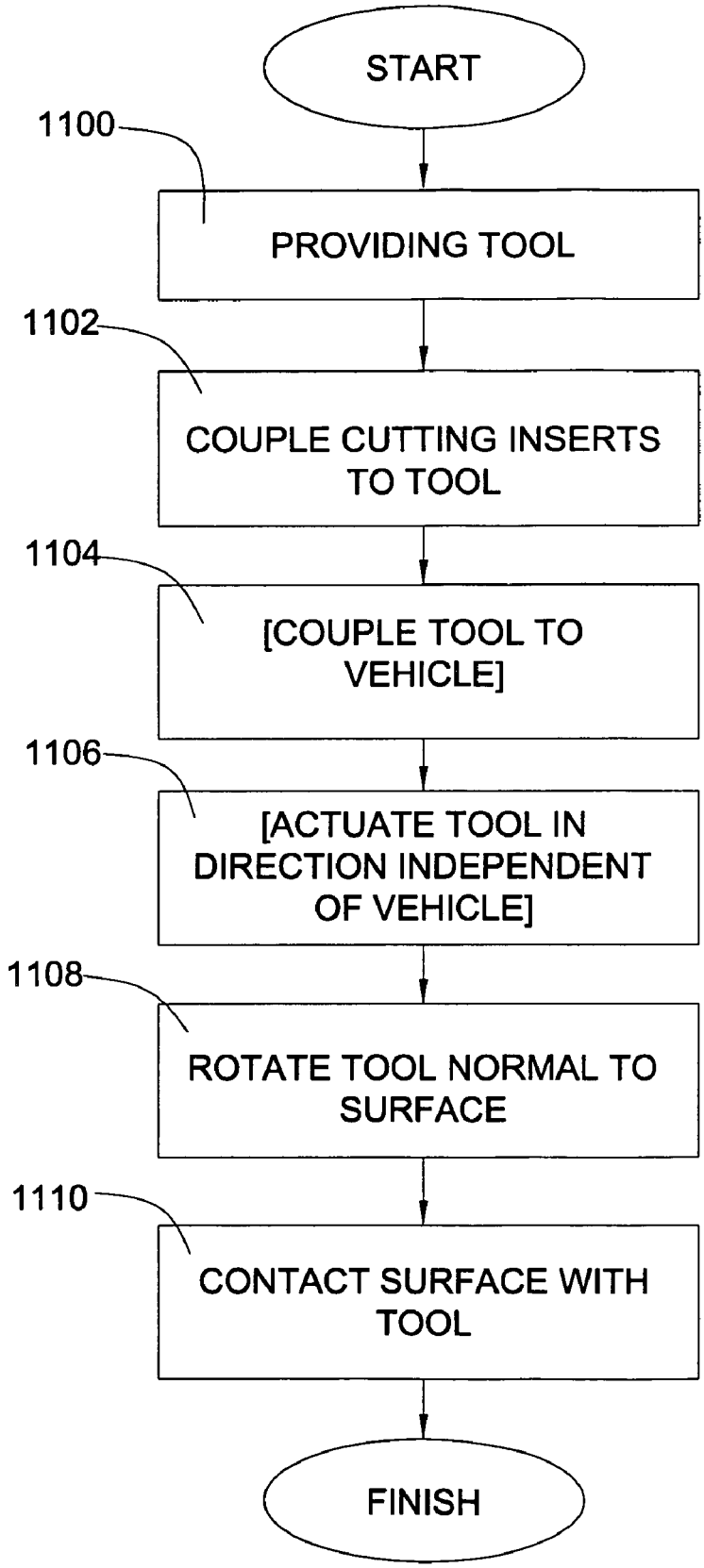
FIG. 11 is a schematic flow chart diagram depicting steps of a method for degrading a paved surface in accordance with the present invention.
Figure 12:
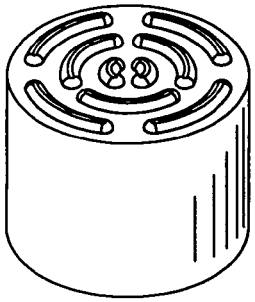
FIGS. 12 through 35 are representative illustrations of substrates comprising non-planar interfacial surfaces.
Figure 13:
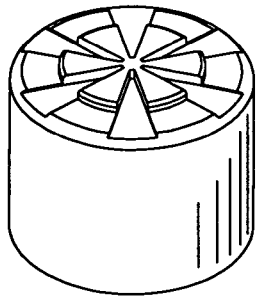
Figure 14:
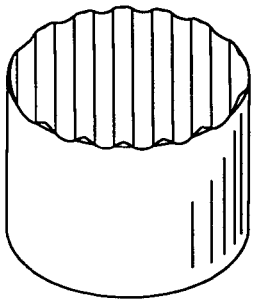
Figure 15:
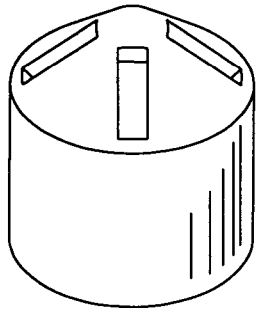
Figure 16:
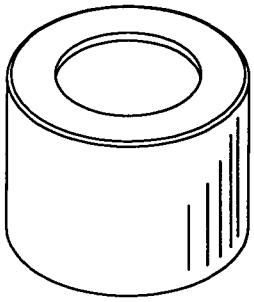
Figure 17:
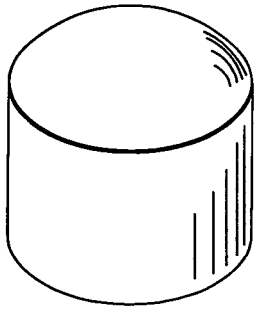
Figure 18:
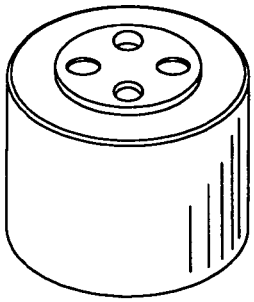
Figure 19:
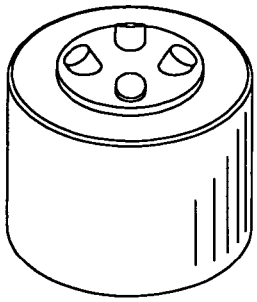
Figure 20:
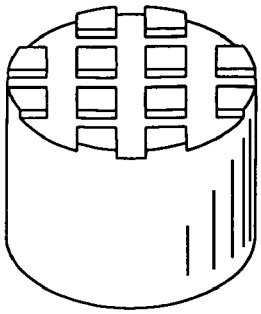
Figure 21:
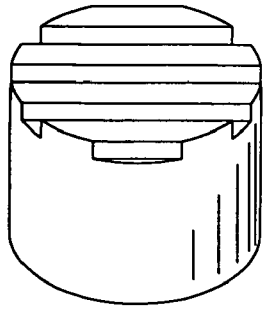
Figure 22:
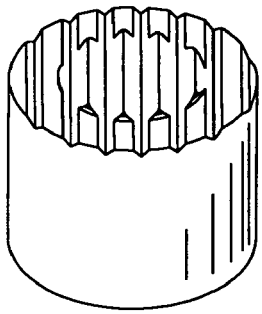
Figure 23:
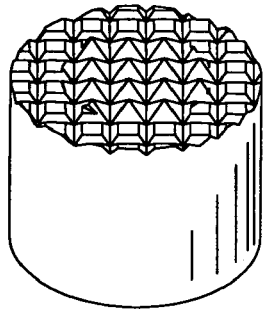
Figure 24:
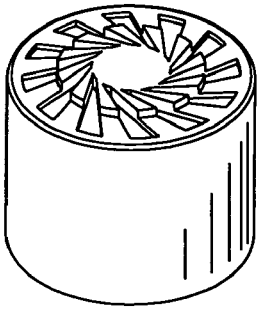
Figure 25:
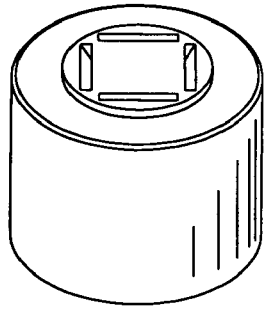
Figure 26:
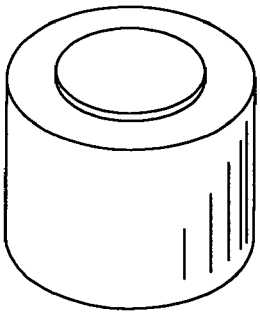
Figure 27:
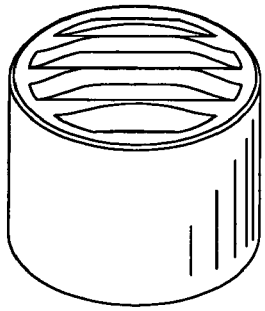
Figure 28:
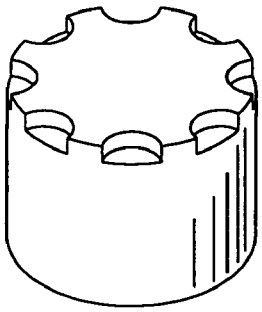
Figure 29:
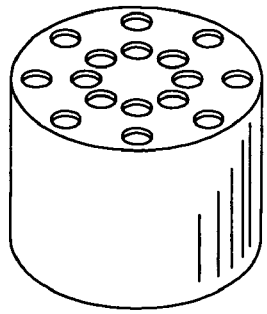
Figure 30:
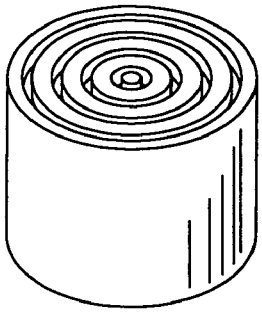
Figure 31:
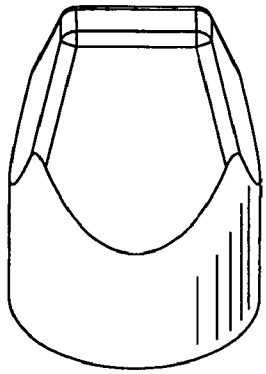
Figure 32:
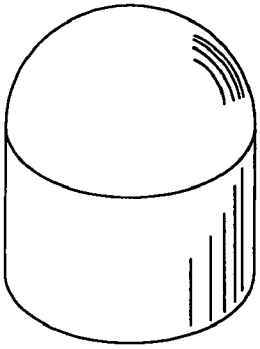
Figure 33:
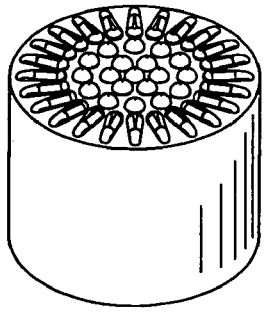
Figure 34:
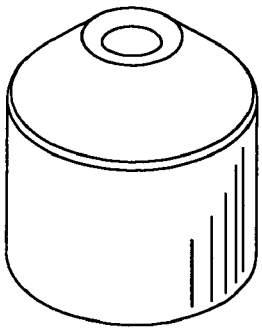
Figure 35:
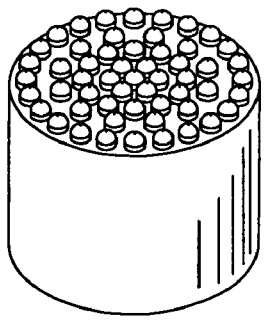

Referring now to FIG. 11, a method for directionally degrading a paved surface in accordance with the present invention may include providing 1100 one or more degradation tools having a top end, a cutting head, and a substantially cylindrical surface; coupling 1102 to the degradation tool a plurality of cutting inserts; rotating 1108 the tool about a rotational axis substantially normal to a paved surface; and contacting 1110 the paved surface with the tool. In certain embodiments, a method may further comprise providing a motorized vehicle to traverse the paved surface; coupling 1104 the tool to the vehicle; and actuating 1106 the tool in a direction independent of the motorized vehicle. For example, as discussed above, one or more degradation tools may be actuated in any of a horizontal, vertical, transverse, diagonal, or pivotal direction relative to the motorized vehicle, or may be actuated in a combination of such directions. In this manner, a method for degrading pavement in accordance with the present invention facilitates customized implementation of a degradation apparatus to avoid particular surface obstacles, adapt to a particular surface geometry, and enable effective pavement degradation while preserving time, labor and wealth.

We claim:

1. An apparatus for directional degradation of a paved surface, comprising:

an attachment assembly connected to a motorized vehicle comprising a plurality degradation tools; at least two of the degradation tools comprising a substantially cylindrical rotary element having a cutting head, a top end, and a substantially cylindrical surface, the substantially cylindrical surface formed about a rotational axis longitudinally extending from the cutting head to the top end, wherein the substantially cylindrical rotary element is adapted to rotate about the rotational axis; and a plurality of cutting inserts embedded within the substantially cylindrical surface and adapted to degrade a paved surface in a direction substantially normal to the rotational axis;

the at least two degradation tools being adapted for at least one of independent and collective movement relative to the attachment assembly.

2. The apparatus of claim 1, further comprising a central bore substantially corresponding to the rotational axis, the central bore adapted to apply rejuvenation materials to the paved surface.

3. The apparatus of claim 1, wherein the cutting head comprises at least one plunging element adapted to impact the paved surface.

4. The apparatus of claim 1, wherein the top end comprises an annular recess adapted to direct degraded pavement particles away from the plurality of cutting inserts.

5. The apparatus of claim 1, wherein the plurality of cutting inserts comprises a substrate bonded to a cutting material.

6. The apparatus of claim 5, wherein the cutting material is selected from the group consisting of polycrystalline diamond and cubic boron nitride.

7. A system for directional degradation of a paved surface, comprising:

a motorized vehicle comprising an attachment assembly; and at least one degradation tool coupled to the attachment assembly and adapted for independent movement relative thereto, the at least one degradation tool comprising a top end, a cutting head and a cylindrical surface, wherein a plurality of cutting inserts are embedded within the cylindrical surface and wherein the at least one degradation tool is adapted to degrade a paved surface in a direction substantially normal to its axis of rotation;

at least two of the degradation tools are adapted for at least one of independent and collective movement relative to the attachment assembly.

8. The system of claim 7, wherein the motorized vehicle is selected from the group consisting of a tractor, a loader, a backhoe, a road grader, a bulldozer, and an excavator.

9. The system of claim 7, wherein the attachment assembly comprises a mounting member extendable beyond a width of the motorized vehicle.

10. The system of claim 7, wherein the at least two degradation tools further comprises an actuating mechanism adapted to actuate the at least two degradation tools in a direction independent of the motorized vehicle.

11. The system of claim 10, wherein the actuating mechanism actuates the at least two degradation tools in at least one of a horizontal, vertical, transverse, diagonal and pivotal direction relative to the motorized vehicle.

12. The system of claim 10, further comprising a control device operatively coupled to the actuating mechanism to control the direction of the at least two degradation tools.

13. The system of claim 12, wherein the control device comprises at least one of an automated feedback system and a manually operated system.

14. The system of claim 7, the plurality of cutting elements comprising a substrate bonded to a cutting material, the cutting material selected from the group consisting of polycrystalline diamond and cubic boron nitride.

15. The system of claim 7, the at least two degradation tools further comprising at least one plunging element integral to the cutting head.

16. A method for directionally degrading a paved surface, comprising:

providing at least two degradation tools, each have a top end, a cutting head, and a substantially cylindrical surface;

coupling to the substantially cylindrical surface a plurality of cutting inserts;

rotating the at least two degradation tools about a rotational axis substantially normal to a paved surface;

contacting the paved surface with the at least two degradation tools to degrade the same; and moving independent or collectively the at least two degradation tools relative to each other.

17. The method of claim 16, further comprising:

providing a motorized vehicle to traverse the paved surface;

coupling to the motorized vehicle the at least two degradation tools; and actuating the at least two degradation tools in a direction independent of the motorized vehicle.

18. The method of claim 17, wherein actuating the at least two degradation tools in a direction independent of the motorized vehicle comprises actuating the at least two degradation tools in at least one of a horizontal, vertical, transverse, diagonal and pivotal direction relative to the motorized vehicle.

* * * * *